United States Patent [19]

Feder

[11] 4,081,631

[45] Mar. 28, 1978

[54] DUAL PURPOSE, WEATHER RESISTANT DATA TERMINAL KEYBOARD ASSEMBLY INCLUDING AUDIO PORTING

[75] Inventor: Alvin Feder, Lauderhill, Fla.

[73] Assignee: Motorola, Inc., Schaumburg, Ill.

[21] Appl. No.: 748,616

[22] Filed: Dec. 8, 1976

[51] Int. Cl.[2] ..... H01H 9/00; G10K 10/00

[52] U.S. Cl. ..... 200/5 A; 200/159 B; 200/340; 181/141; 235/146

[58] Field of Search ..... 200/5 A, 159 B, 340; 179/179; 235/156; 181/141

[56] References Cited

U.S. PATENT DOCUMENTS

| | | | |
|---|---|---|---|
| 3,439,568 | 4/1969 | Griffith | 200/340 X |
| 3,668,356 | 6/1972 | Kekas | 200/340 X |
| 3,728,509 | 4/1973 | Shimojo | 200/159 B |
| 3,879,586 | 4/1975 | DuRocher et al. | 200/159 B X |
| 3,959,610 | 5/1976 | Finnegan et al. | 200/340 X |
| 4,038,502 | 7/1977 | Ambruoso, Sr. et al. | 179/179 |

*Primary Examiner*—James R. Scott
*Attorney, Agent, or Firm*—Margaret Marsh Parker; James W. Gillman

[57] ABSTRACT

An improved data terminal utilizing tactile switch assemblies with specialized sound apertures provide reduced panel space requirements and indirect sound paths for miniature electronic apparatus. A maximum number of switches can be accommodated on the instrument panel with no separate speaker/microphone grille required. Non-aligned sound apertures provide maximal weather protection for speaker and microphone mounted behind the switch assembly panel. The switch assembly design seals off the remainder of the unit from weather or dust damage.

8 Claims, 4 Drawing Figures

DUAL PURPOSE, WEATHER RESISTANT DATA TERMINAL KEYBOARD ASSEMBLY INCLUDING AUDIO PORTING

BACKGROUND OF THE INVENTION

This invention relates to the field of miniature electronic apparatus including multiple switch assemblies and audio transducers and more particularly to a tactile switch assembly including the function of a speaker grille.

In miniature electronic devices such as hand-held, two-way communications apparatus, it is desirable to be able to add functions without increasing the size of the unit. One important addition is a portable data terminal which might be used, for example, by a police officer for direct interrogation of automobile registration records. The officer enters his request via an alphanumeric keyboard, the input is encoded in binary form and transmitted to a computer or central processor unit (CPU). The CPU will check the records and transmit back the needed answer, e.g., the owner's name and address, whether the vehicle has been reported stolen, etc. The return transmission is decoded and displayed on an LED readout display. The query and response are accomplished more quickly and more efficiently than by using two-way voice communication and having a person look up the needed information in a file. Switch assemblies suitable for such a keyboard are known in the art, but a space problem arises when attempting to include a loudspeaker/microphone grille, data terminal including perhaps 40 keys, and a readout display all in a hand-held device measuring less than 3 inches (8 centimeters) by 6 inches (15 centimeters). The maximum degree of weather and contamination protection is also a requirement in such portable equipment.

SUMMARY OF THE INVENTION

It is, therefore, an object of the present invention to provide combined data terminal and speaker grille functions in miniature communications apparatus.

It is a particular object to provide these functions in a unit having a high degree of weather resistance.

It is a specific object to accomplish the above objectives without increasing the overall dimensions of the unit.

The above objectives are accomplished in an electronic apparatus in accordance with the invention by an improved data terminal structure providing indirect sound paths through the key buttons of the data terminal and by specially designed apertures in the key switch assembly which are not in alignment with the key buttons. The remainder of the unit is sealed off by the key switch assembly which includes a sheet of insulating material having depressible portions formed therein. In the center of each depressible portion is a conductive bridging contact. Adjacent and parallel to the insulating sheet is a printed circuit board having contacts affixed thereon, positioned in alignment with the bridging contacts. The key buttons having the indirect sound paths therethrough are molded of an insulating material, and include a flange which is retained between the front panel of the apparatus housing and the insulating sheet bearing the bridging contacts, a body portion of the key button projecting through the front panel. Thus, when a key button is depressed, as by a finger of the operator, the back portion of the button causes the corresponding depressible portion of the insulating sheet to flex, in turn causing a bridging contact thereon to close the corresponding switch contacts on the printed circuit board.

DETAILED DESCRIPTION OF A PREFERRED EMBODIMENT

Figure 1:
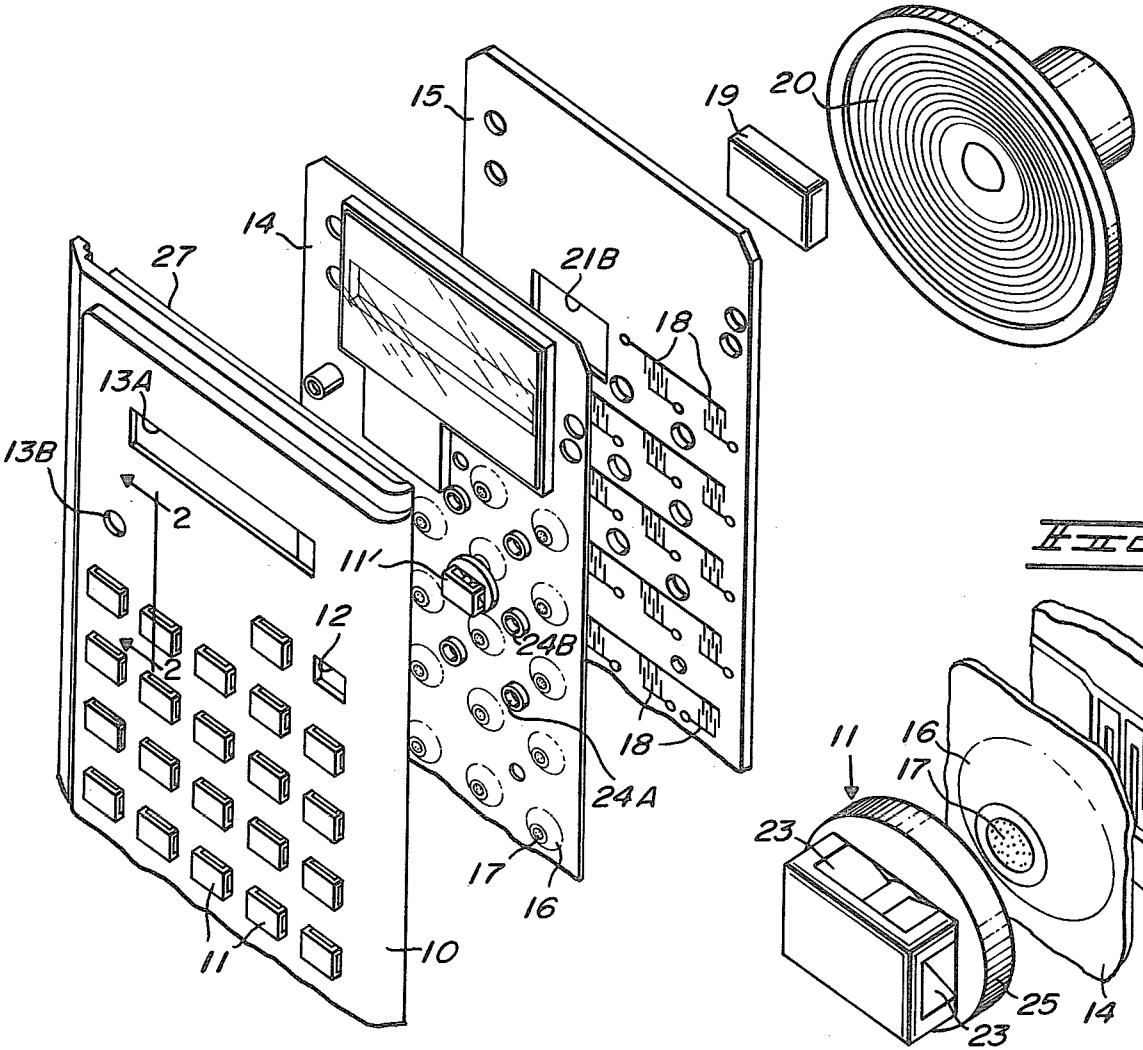
FIG. 1 is an exploded, perspective view of the assembly according to the invention.

Referring now more particularly to the drawing, FIG. 1 shows an embodiment of the invention having a front panel 10 for supporting the switch assemblies and other components (not shown). The panel 10 is preferably of a semi-rigid plastic and may constitute a portion of the housing of an electronic apparatus, typically hand-held, such as a two-way radio for security and emergency use. A number of key buttons 11 are shown projecting through corresponding apertures 12 in the panel 10. One button 11′ is shown detached from contact with the panel for clarity. The conformation of the key button will be described more fully hereinafter.

In addition to the apertures 12, there may be other apertures as required, such as an elongated window 13A over an LED readout display and a small aperture 13B for a single LED which could be used for a "clear channel" indicator. The pertinent requirement regarding each such aperture is that it have provision for weather and contamination seal.

A switch panel 14 and a printed circuit board 15 are provided, which may be designed to be snugly retained on the rearmost side of the panel 10. The switch panel 14 is preferably molded of a thin insulating material and has raised areas 16 corresponding in number and placement to the key buttons 11 and apertures 12. The areas 16 are thinner than the remainder of the panel 14 and are capable of being depressed easily by the key buttons 11 out of their normally raised position, then being self-restoring to that position. In the center of each area 16 is a small bridging contact 17 of a conductive material. The contacts 17 are preferably comprised of a conductive elastomer such as a silicone or fluorosilicone containing carbon or metallic particles. The resistance of this material should be such that, in the period of initial engagement with the contacts on the printed circuit board, current flow will be below the threshold current for the logic elements which are being switched. This characteristic allows the resistance value, and thus the current, to become stabilized before an effective value of current flows to the logic elements. The time required for this stabilization to take place is so brief as to have no effect on the speed of operation of the device. This type of switch is known in the art as a "tactile switch". It has the advantage of providing the user with a positive and almost noiseless tactile indication of contact, eliminating the need for audible signals for this purpose, and thus the need for wiring and componenets to produce such signals. In the present application, more important advantages of such switch panel 14 are that there are no switch parts below the key buttons 11 which could be affected by moisture or dirt, no openings to allow moisture and dirt to pass through panel 14, (except those leading to the transducer) and no need for a separator mask between the bridging contacts 17 and the switch contacts 18. The switch panel 14 is known in the art and is shown herein only in an exemplary fashion.

The printed circuit board 15 may be constructed according to any suitable technique known in printed circuit art. One the side of the board adjacent the switch panel 14, and aligned with each bridging contact thereon, are pairs of switch contacts 18. These may take the form shown in FIGS. 1 and 3, i.e., each cooperating pair of contacts may consist of inter-digitated fingers of a conductive material printed or plated on the insulating material. One group of fingers would make up one contact, and the alternate ones the second contact. These contacts are dimensioned and positioned so that depression of a key button 11 will depress the underlying raised area 16, allowing the bridging contact 17 to provide a low resistance connection across the corresponding contacts 18. Connecting leads to the contacts 18 may be as shown or on the rearmost side of the printed circuit board 15 (not shown) with plated-through connections. It is understood that the complete electronic device will contain other circuitry (not shown) some of which may be attached to the rearmost side of the printed circuit board 15.

Figure 2:
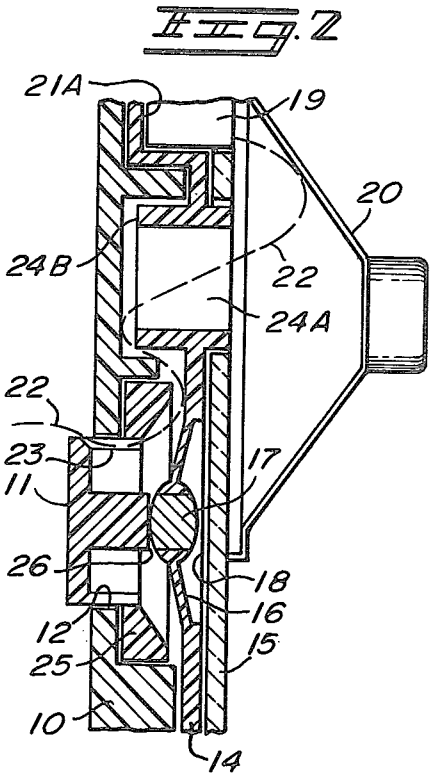
FIG. 2 is a sectional view of a portion of the embodiment of FIG. 1 taken along the line 2—2.

A microphone 19 and a speaker 20 are shown in FIG. 1 and partially in FIG. 2 for providing audio output and pick up for the device. The microphone 19 is retained in a recess 21A in the rearmost side of the switch panel 14 and in an aperture 21B in the printed circuit board 15. The sound aperture of the microphone 19 faces the speaker 20 and receives sound energy as will be described in connection with FIG. 2. The speaker 20 faces the rearmost side of the printed circuit board 15.

Figure 4:
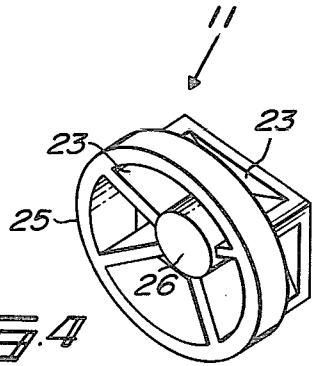
FIG. 4 is a perspective, back view of the switch button of FIG. 3.
Figure 3:
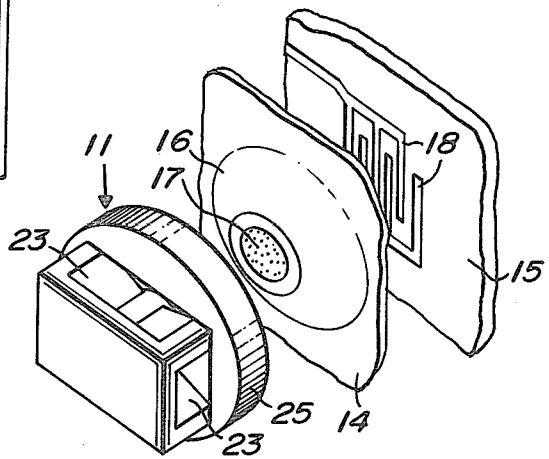
FIG. 3 is an enlarged, perspective view of one switch assembly of FIG. 1.

Shown in FIG. 2 is an indirect path 22 for sound from the exterior of the housing to the microphone 19 and from the speaker 20 to the exterior. Referring to FIGS. 3 and 4, a preferred conformation of a key button 11 in front and back views shows clearly that sound can pass through the side openings 23 of all undepressed buttons 11 and into the space between the front panel 10 and the switch panel 14. From this space, the sound will travel the indirect path 22 through a plurality of passages 24 in switch panel 14. Bosses 24A around the passages 24 provide additional weather and contamination protection for the speaker and microphone. From the passages 24, sound waves move to and from the microphone 19 and speaker 20.

FIG. 3 shows an enlarged detailed view of one of the switch assemblies, including a key button 11 having a flange portion 25 which is retained behind the panel 10 (FIGS. 1 and 2). The normally raised area 16 of the switch panel 14, with its bridging contact 17, is shown undepressed. One pair of inter-digitated switch contacts 18 is shown on a portion of the printed circuit board 15. The back view of the button 11 in FIG. 4 shows the portion 26 which presses down on the bridging contact 17 when the button 11 is depressed by a user. The printed circuit board 15 and switch panel 14 are snugly retained within a rim portion 27 (FIG. 1) of the front panel 10 by a number of screws (not shown) which thread through the rearmost side of the front panel. No path is provided whereby moisture or dirt can reach the circuitry behind the printed circuit board, short of immersion.

Thus, there has been provided a panel having a large number of alphanumeric and function keys for controlling a portable data terminal, in which the keys provide sound access as usually provided by a separate speaker grille. The complete switching assembly provides a very indirect sound path in and out of the unit, and maintains the splashproof characteristic of the unit.

Athough the invention has been shown in a specific embodiment, it is obvious that other variations and modifications are possible and it is intended to include all such as fall within the spirit and scope of the appended claims.

What is claimed is:

1. A dual purpose, weather resistant data terminal keyboard arrangement suitable for use in electronic apparatus which includes audio transducer means, the arrangement comprising:

a housing cover having a plurality of apertures selectively arranged therein;

a multiplicity of key buttons having normal and depressed positions and supported immediately adjacent the rearmost side of the housing cover, each including a portion projecting through one of the housing cover apertures, the portions having apertures extending from above the upper surface of the housing cover to below the lower surface when the key button is in the normal position;

a switching assembly positioned closely adjacent the rearmost side of the housing cover and having portions adjacent the key buttons spaced apart therefrom when said key buttons are in the normal position, the assembly having switches thereon for cooperating with the key buttons to close circuits in the apparatus, the assembly having apertures therethrough non-aligned with the housing cover and key button apertures; and wherein when the transducer means is positioned immediately adjacent the rearmost end of the switching assembly apertures, weather protection for and indirect sound paths to the transducer means are provided through the apertures in the housing cover, the key buttons and the switching assembly.

2. A dual purpose keyboard arrangement according to claim 1 wherein the support panel is the front portion of an electronic apparatus housing.

3. A dual purpose keyboard arrangement according to claim 1 wherein the transducer means includes a microphone and a speaker.

4. A dual purpose keyboard arrangement for an electronic apparatus including audio transducer means, the arrangement comprising:

a housing cover having a multiplicity of apertures therein;

a non-conductive switch panel supported immediately adjacent the rearmost side of the housing cover for retaining a plurality of conductive bridging elements in alignment with the apertures in the housing cover, and having portions thereof spaced apart from the housing cover with apertures therein through said spaced apart portions and positioned for non-alignment with the apertures in the housing cover;

a rigid insulating member adjacent the rearmost side of the switch panel, having switch contacts affixed thereon in alignment with the bridging elements and having apertures therein positioned in alignment with the apertures in the switch panel;

a pluarlity of key button means, each comprising a body portion for mating with and projecting through an aperture in the housing cover, for causing a bridging element to bridge the corresponding switch contacts upon depression of the key button means, and having at least one aperture extending from above the upper surface of the housing cover to below the lower surface when the key button is in the normal position; and a flange portion for being retained between the housing cover and the insulating member, and wherein when the transducer means is positioned adjacent the rearmost side of the insulating member weather protection for and indirect sound paths to the transducer means are provided through the apertures in the undepressed key button means, the housing cover, the switch panel and the insulating member.

5. A dual purpose keyboard arrangement according to claim 4 wherein the bridging elements are supported by thinned, normally raised and self-restoring areas of the switch panel, and are of a material having conductive elements therein.

6. A dual purpose keyboard arrangement according to claim 4 wherein the bridging elements become conductive under compressive force.

7. A dual purpose keyboard arrangement according to claim 4 wherein the insulating member is a circuit board and the switch contacts are plated thereon.

8. A dual purpose keyboard arrangement according to claim 4 wherein the switch contacts are interdigitated elements.

* * * * *